US005280982A

United States Patent [19]

Kobayashi

[11] Patent Number: 5,280,982

[45] Date of Patent: Jan. 25, 1994

[54] CLAMP DEVICE FOR TRANSFERRING CONSTRUCTION MATERIAL

[75] Inventor: Shoichi Kobayashi, Chiba, Japan

[73] Assignee: Kabushiki Kaisha SK, Chiba, Japan

[21] Appl. No.: 957,768

[22] Filed: Oct. 15, 1992

[30] Foreign Application Priority Data

Oct. 21, 1991 [JP] Japan ..... 3-320063
Sep. 25, 1992 [JP] Japan ..... 4-280695

[51] Int. Cl.[5] ..... B66C 1/44

[52] U.S. Cl. ..... 294/116; 294/118

[58] Field of Search ..... 294/16, 86.4, 94, 95, 294/110.1, 116, 117, 118, 902

[56] References Cited

U.S. PATENT DOCUMENTS

| | | | |
|---|---|---|---|
| 621,356 | 3/1899 | Marsh | 294/118 |
| 1,938,485 | 12/1933 | Cossor | 294/116 X |
| 2,215,844 | 9/1940 | Van Syckle | 294/116 X |
| 2,857,193 | 10/1958 | Heppenstall | 294/86.4 X |
| 4,098,533 | 7/1978 | Hanlon. Jr. | 294/116 |
| 4,324,125 | 4/1982 | Jarman et al. | 294/116 X |
| 4,368,913 | 1/1983 | Brockmann et al. | 294/116 X |

FOREIGN PATENT DOCUMENTS

| | | | |
|---|---|---|---|
| 115089 | 5/1991 | Japan | 294/110.1 |
| 1237607 | 6/1986 | U.S.S.R. | 294/110.1 |

*Primary Examiner*—David M. Mitchell
*Assistant Examiner*—Dean Kramer
*Attorney, Agent, or Firm*—Stanley P. Fisher

[57] ABSTRACT

A clamp device for transferring a construction material capable of eliminating manual handling of the construction material prior to transferring of the construction material, leading to labor saving. First and second brackets are connected to each other through a joint and a second bracket is engaged with a clamp. The first bracket is suitably mounted on an arm of a civil engineering machine such as a hydraulic shovel and the second bracket is provided with guide slits, in which shafts or pins of the clamp are engagedly fitted.

8 Claims, 7 Drawing Sheets

CLAMP DEVICE FOR TRANSFERRING CONSTRUCTION MATERIAL

BACKGROUND OF THE INVENTION

This invention relates to a clamp device for transferring a construction or building material, and more particularly to a clamp device which is adapted to be mounted through any suitable means on an arm of a civil engineering machine such as a hydraulic shovel or the like; a bracket attached to the arm or any other attachment attached to the arm such as a bucket; a clamper or the like to transfer a construction or building material such as a U-shaped gutter; a block; or a Hume pipe or the like to a desired target location while holding or clamping it.

In general, work on a construction or building material (hereinafter referred to as "construction material") such as a U-shaped gutter or the like usually involves arrangement or storage of the construction material; loading and unloading of the construction material with respect to a truck or the like in a manufacturing factory; and a constructor. This work is generally carried out manually. However, it is very hard or substantially impossible to manually handle a construction material which weighs between 500 to 1000 kg such as a large-sized U-shaped gutter or the like. Therefore, a system which uses any convenient means such as a hook would aid in the handling of the construction material. Typically, a wire and a clamp is employed for handling and transferring of the construction material.

Such a handling and transferring system as described above, as shown in FIG. 8, includes a hook 11 which is fixedly mounted by welding on any attachment, such as a bucket 14, connected to an arm 1 of a hydraulic shovel. A wire 13, held at a proximal end thereof on the hook 11, has a clamp 12 mounted on a distal end thereof. The clamp 12 is actuated in association with vertical movement of arm 1, to thereby transferring a construction material 10 while suspending and automatically clamping it.

More specifically, initially, a worker manually operates clamp 12, keeping clamp 12 open so as to permit clamp 12 to get astride construction material 10. Then arm 1 is raised, so that wire 13 is stretched to close clamp 12, resulting in the clamp 12 holding construction material 10. The more construction material 10 weighs, the more clamp 12 is pulled upwardly, through wire 13, to firmly hold construction material 10. Thus, the system permits construction material 10 to be positively transferred to any desired place irrespective of the weight of construction material 10.

The conventional handling and transferring system smoothly accomplishes a normal operation of satisfactorily actuating arm 1 to gradually stretch wire 13 to increase a holding force of clamp 12. This is because of wire 13. However, excessive or violent actuation of arm 1 or sudden inclination or falling of construction material 10, due to unbalanced clamping of construction material 10 by clamp 12, causes the stretching of wire 13 to be suddenly varied. This results in the clamping force of clamp 12 being suddenly decreased or a large magnitude of the force being accidentally applied to hook 11, wire 13 and/or clamp 12. This often causes releasing of construction material 10 from clamp 12; cutting of wire 13; and damage to hook 11 or the like, which, in turn, may lead to serious trouble or accident.

Therefore, it would be desirable to develop a novel and improved device which is capable of eliminating the above-described disadvantages encountered with conventional handling and transferring systems.

SUMMARY OF THE INVENTION

The present invention has been made in view of the foregoing disadvantages of the prior art.

Accordingly, it is an object of the present invention to provide a clamp device for transferring a construction material which is capable of enhancing safety in transferring of construction materials.

It is another object of the present invention to provide a clamp device for transferring construction materials which are capable of eliminating manual handling of construction materials prior to transferring of construction materials.

It is a further object of the present invention to provide a clamp device for transferring a construction material which is capable of accomplishing labor saving.

It is still another object of the present invention to provide a clamp device for transferring a construction material which is capable of readily accomplishing transferring of the construction material with high efficiency.

In accordance with the present invention, a clamp device for transferring a construction material is provided which is adapted to be mounted directly or indirectly on an arm of a hydraulic shovel. The clamp device includes a first bracket mounted on the arm of the hydraulic shovel, a second bracket formed with guide slits, a joint for connecting the first and second brackets to each other, and a scissors-like clamp including arm members each provided at an upper end thereof with a shaft or pin and at a lower end thereof with a non-slip means. The arm members are pivotally connected to each other through a pivot. The pins of the arm members are slidably fitted in the guide slits of the second bracket, to thereby connect the clamp to the second bracket.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Figure 1:
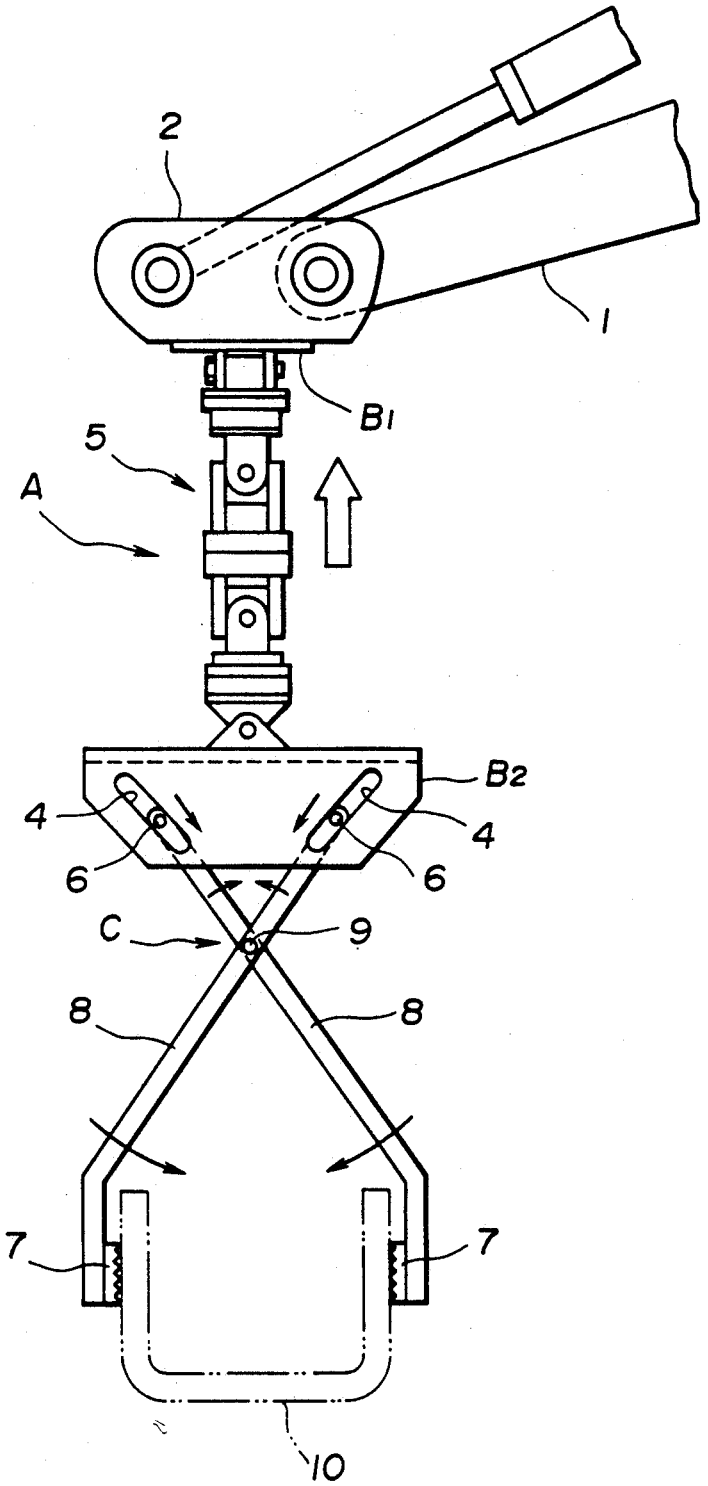
FIG. 1 is a front elevation view showing an embodiment of a clamp device for transferring a construction material constructed according to a preferred embodiment the present invention, which is mounted on a bracket attached to an arm of a hydraulic shovel.

A clamp device for transferring a construction material according to the present invention will be described hereinafter with like reference numerals designating like or corresponding parts throughout the drawings.

A clamp device for transferring a construction material according to the present invention incudes a first bracket B1 adapted to be mounted directly on the arm 1 of a hydraulic shovel or indirectly on arm 1 through a suitable bracket 2 attached to arm 1 or any other attachment attached to arm 1 such as, for example, a hydraulic chuck or the like. Such mounting of first bracket B1 on arm 1 may be carried out using any suitable means such as welding, bolting or the like. Also, the clamp device incudes a second bracket B2 provided with a pair of guide slits 4, extending vertically obliquely in a substantially symmetric manner. Brackets B1 and B2 are connected, through a joint 5 of a suitable construction, to each other.

The clamp device of the present invention further includes a scissors-like clamp C. The clamp C includes arm members 8. Each arm member 8 is provided at an upper end thereof with a shaft or pin 6 and at a lower end thereof with a non-slip section 7. Arm members 8 are pivotally connected through a pivot 9 to each other. The shafts or pins 6 of arm members 8 are slidably fitted in guide slits 4 of second bracket B2, to thereby connect clamp C to second bracket B2.

Figure 6:
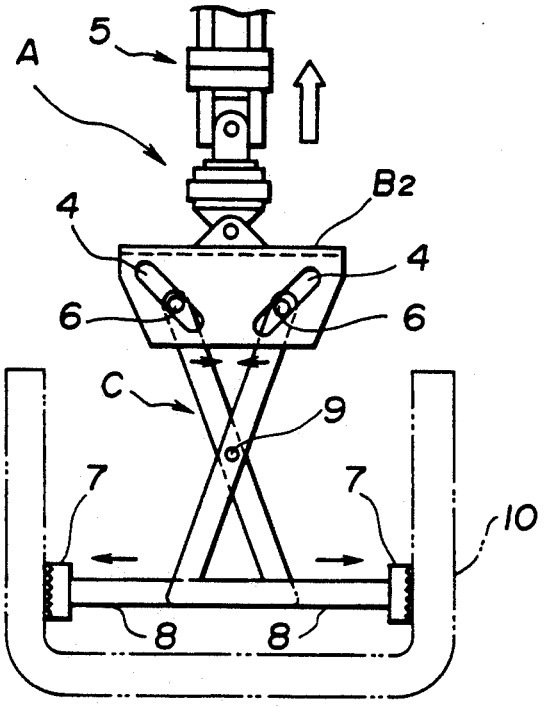
FIG. 6 is a front elevation view showing another embodiment of a clamp device for transferring a construction material according to the present invention.
Figure 7:
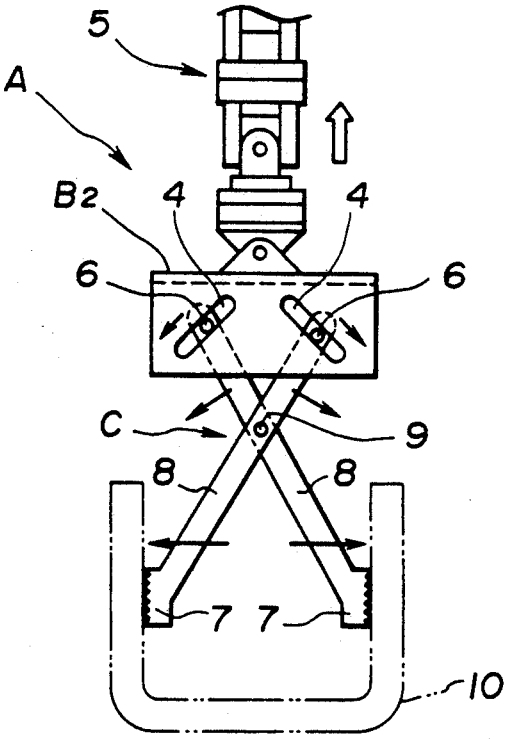
FIG. 7 is a front elevation view showing a further embodiment of a clamp device for transferring a construction material according to the present invention.
Figure 8:
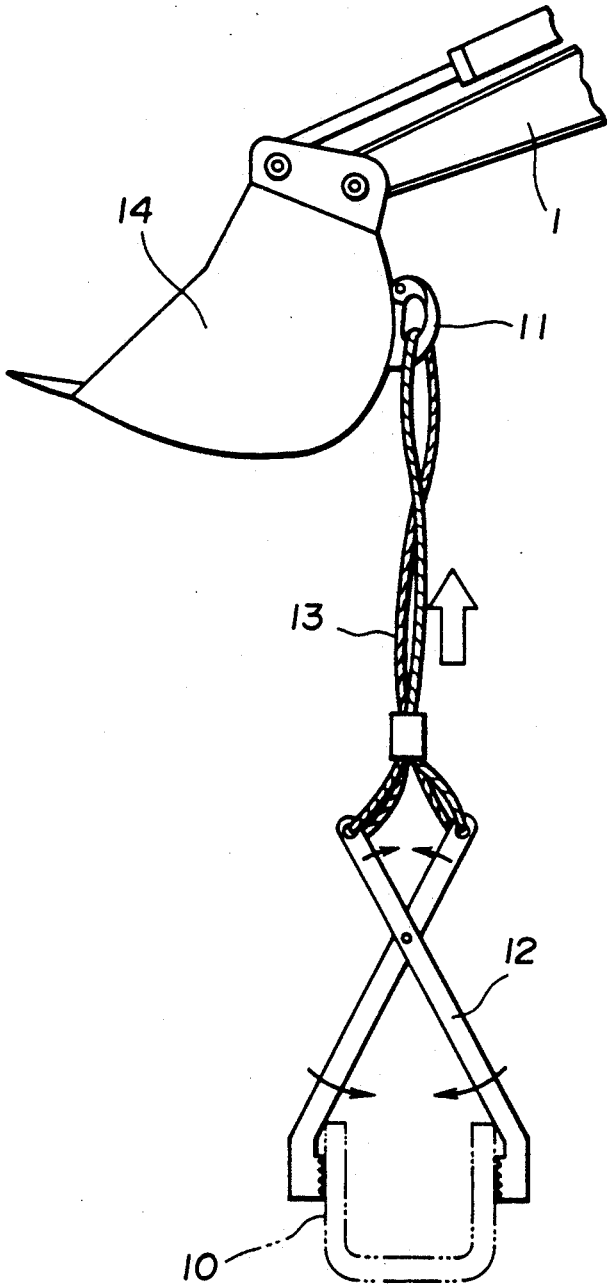
FIG. 8 is a front elevation view showing a conventional handling and transferring system for a construction material including a hook, a wire and a clamp, wherein the hook is fixed on a bucket attached to an arm of a hydraulic shovel.

Second bracket B2 may comprise a box which is open at a bottom thereof. Alternatively, second bracket B2 may comprise a plate which is open at a bottom thereof. Guide slits 4 of second bracket B2 may be formed so that the upper ends thereof approach each other and the lower ends thereof are kept away from each other, as shown in FIGS. 1, 2, 5 and 6. Alternatively, guide slits 4 may be so formed that the upper ends are kept away from each other and the lower ends thereof approach each other, as shown in FIG. 7. It should be appreciated that grooves may be substituted for slits 4.

The arm members 8 of the clamp C, as described above, are pivotally connected at the central portion thereof through pivot 9 to each other. Connection between arm members 8 may be carried out so as to form an X-like shape in cooperation with each other, as shown in FIGS. 1, 2, 5 and 7 Alternatively, arm members 8, as shown in FIG. 6, may have a substantially L-shaped configuration and may be symmetrically arranged about pivot 9.

The non-slip section 7, provided on the lower end of each of the arm members 8, may comprise a suitable non-slip means such as, for example, a non-slip projection, a non-slip rubber member or the like. Non-slip section 7 is arranged opposite to a surface or side of a construction material 10 engaged by arm member 8.

Figure 4:
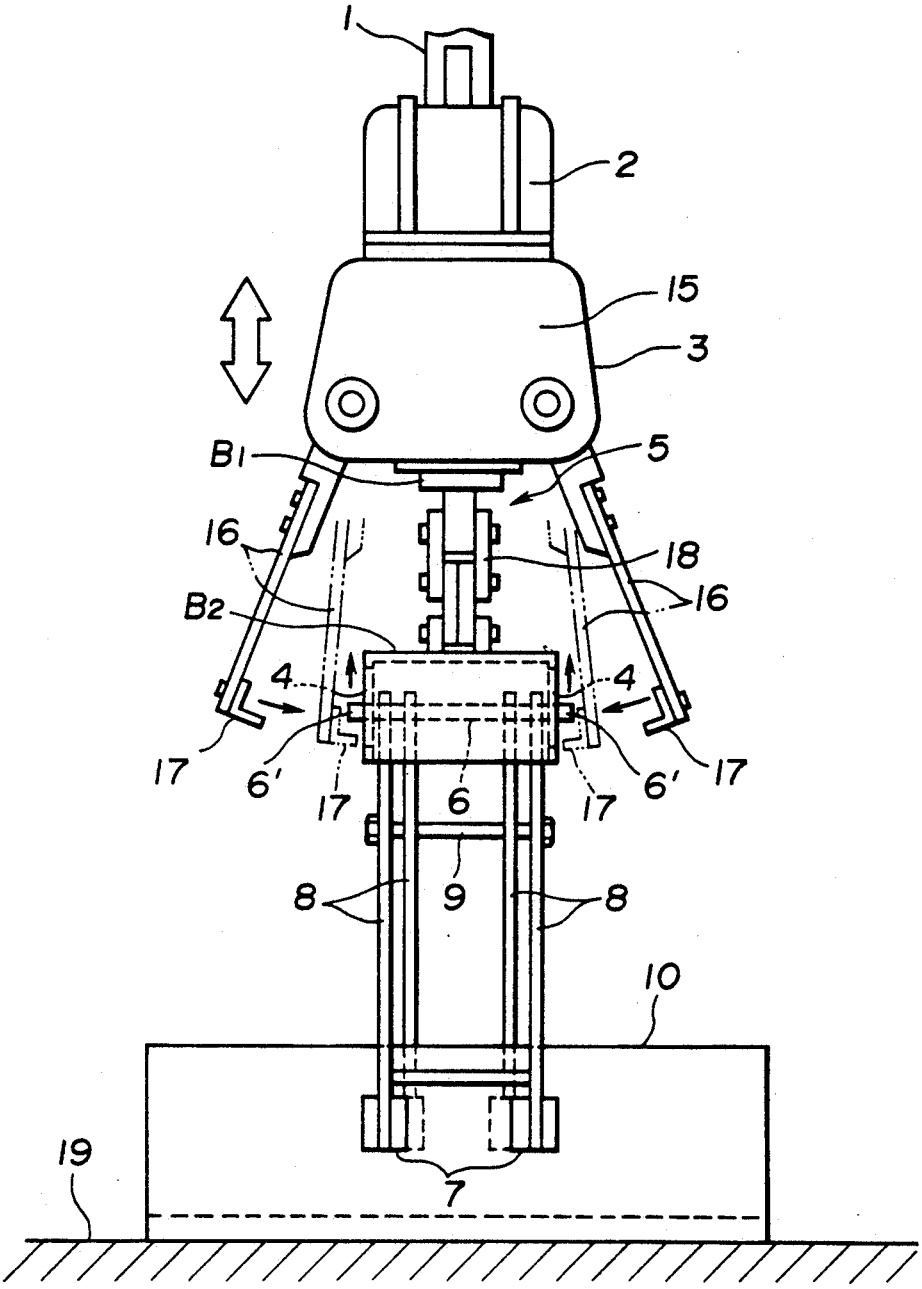
FIG. 4 is a left side view of the clamp device shown in FIG. 3.

A hydraulic chuck 3, which is one example of an attachment attached to the arm 1 of the hydraulic shovel as shown in FIG. 4, may include a pair of chuck arms 16 connected to a box 15 mounted on bracket 2 so as to be pivotally moved over an angle of 360 degrees. The chuck arms 16 are each arranged in a manner to be laterally pivotable about a connection of chuck arm 16 to box 15, to thereby be engaged with a side of construction material 10 in the form of a U-shaped gutter. Such a chuck mechanism is disclosed in Japanese Utility Model Application Laid Open Publication No. 24584/1992 (4-24584).

Figure 2:
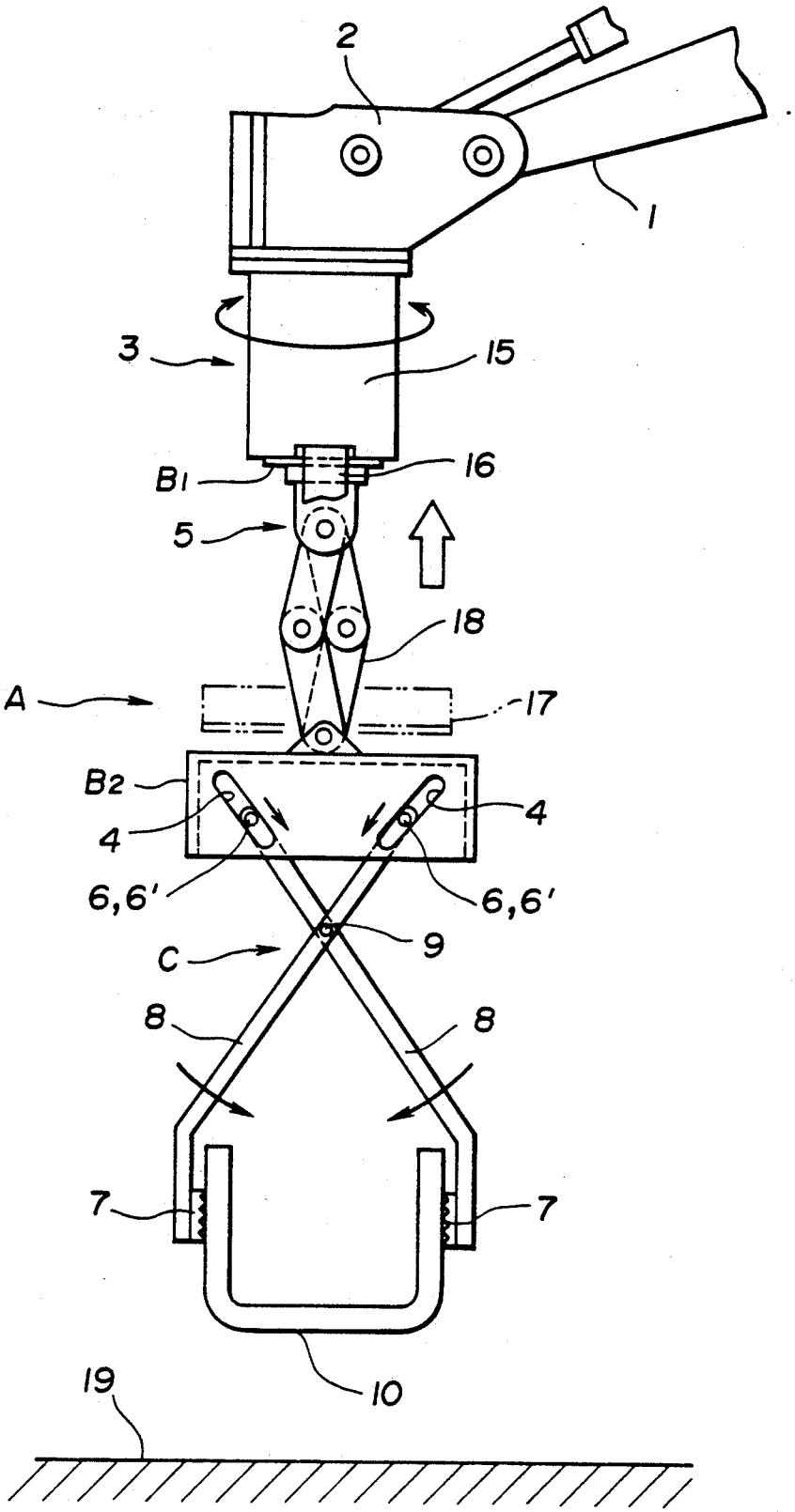
FIG. 2 is a front elevation view of the clamp device shown in FIG. 1, which is mounted on a hydraulic chuck attached to an arm of a hydraulic shovel and of which arm members are raised to lift a construction material while holding it thereon.
Figure 3:
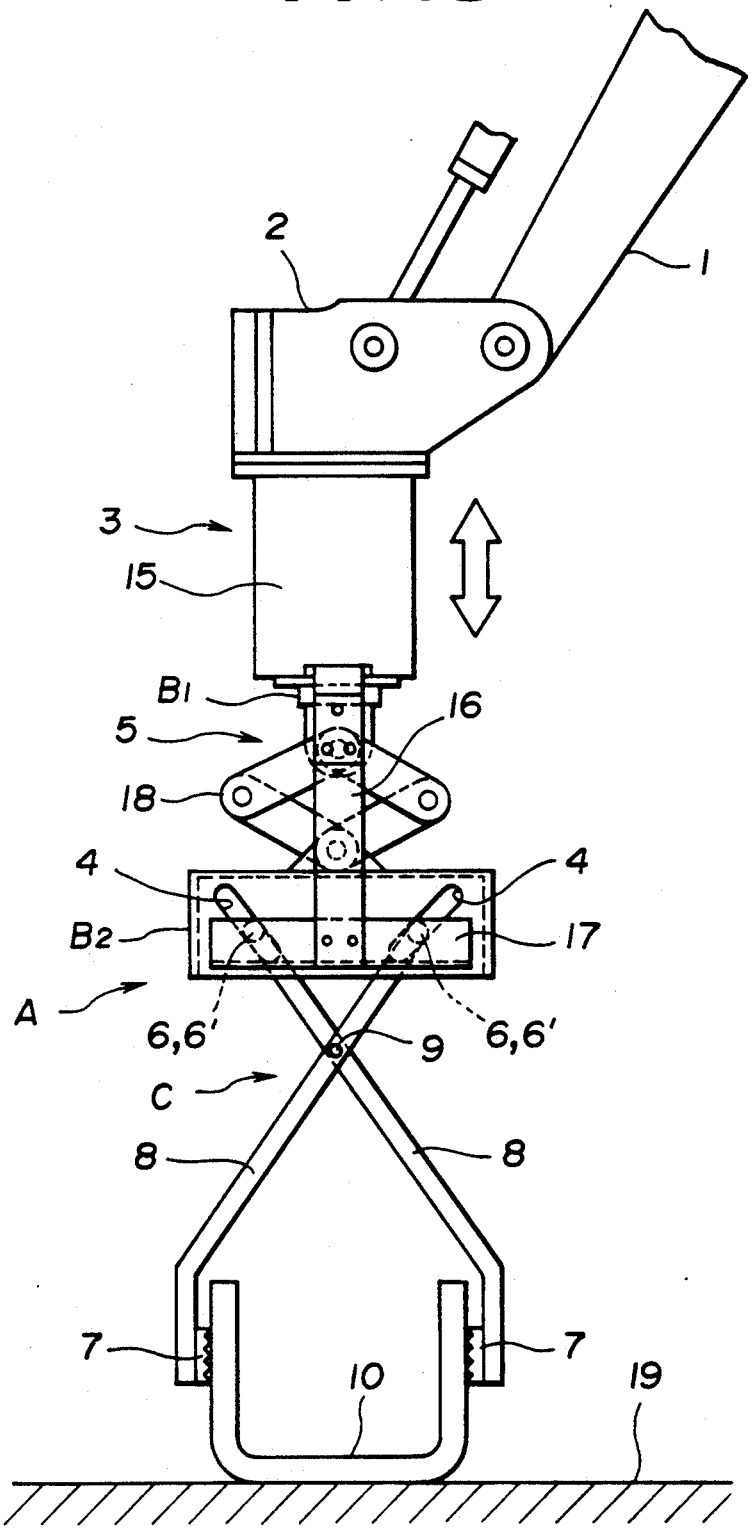
FIG. 3 is a front elevation view of the clamp device shown in FIG. 2, of which arm members are lowered to unload a construction material therefrom.

FIGS. 2 to 4 described above illustrate the embodiment of the present invention utilizing such a hydraulic chuck 3 as described above. The chuck arms 16 of hydraulic chuck 3 mounted on arm 1 of the hydraulic shovel are each fixedly mounted on an inner side of a distal end thereof with an L-shaped plate-like shoe 17. The joint 5 through which first bracket B1 is fixed on the box 15 of the hydraulic chuck 3 and second bracket B2 are connected to each other is provided therein with a pantograph-like expandable joint 18. Also, shaft or pin 6 is engagedly fitted into each respective guide slit 4 of second bracket B2. The pins 6 are arranged in such a manner that both ends 6' thereof project outwardly from guide slits 4. Further, lateral shoes 17 are positioned below distal ends 6' of shaft or pin 6 when the lower end of each of arm members 8 of clamp C or construction material of U-shaped gutter 10 is abutted against the ground to contract expandable joint 18 as shown in FIGS. 3 and 4.

Figure 5:
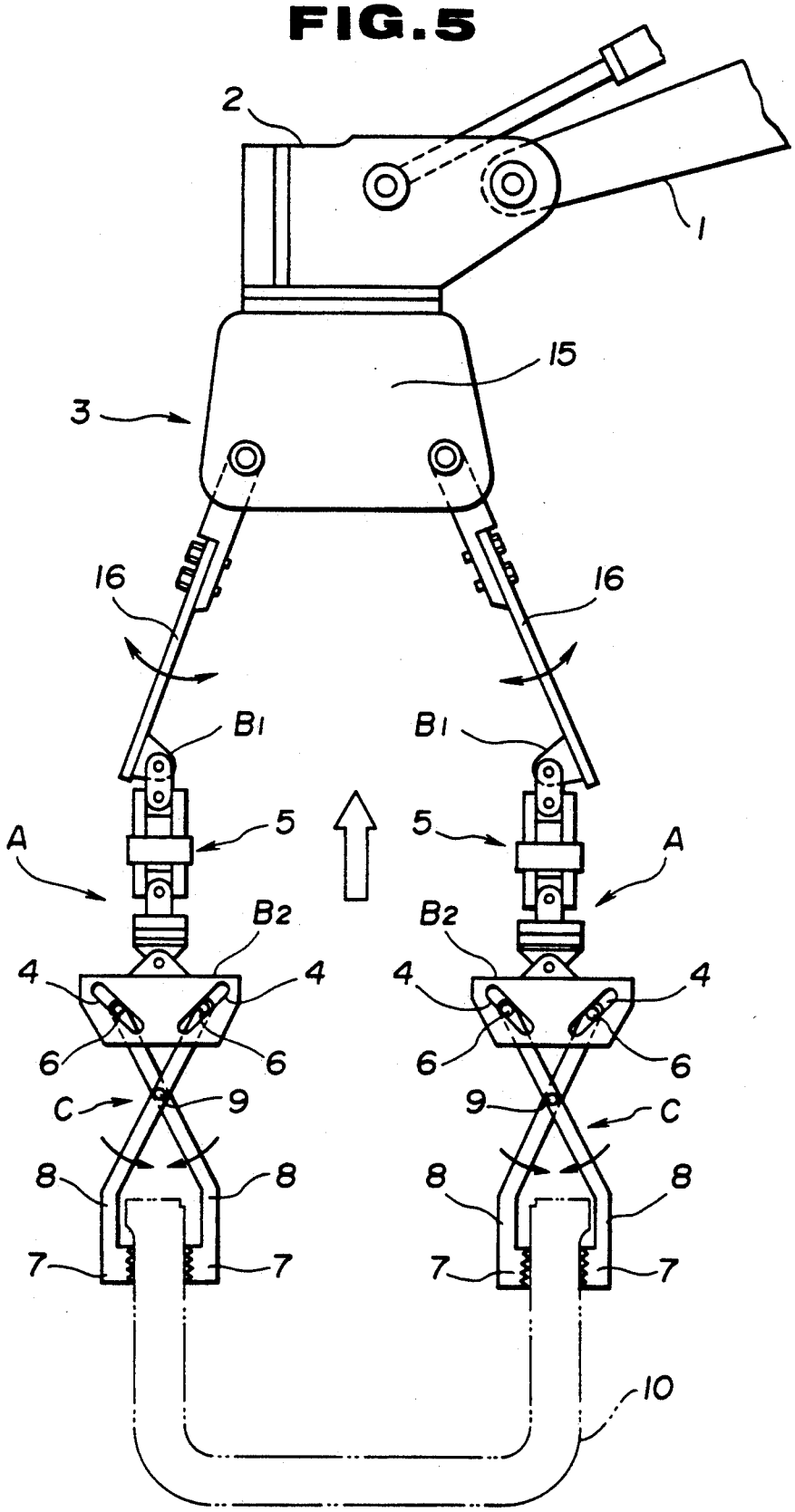
FIG. 5 is a front elevation view of the clamp device shown in FIG. 1, which is mounted on a distal end of each of chuck arms of a hydraulic chuck attached to an arm of a hydraulic shovel.

In each of the embodiments shown in FIGS. 1 and 5, when arm 1 of the hydraulic shovel is lowered to abut the lower end of clamp C against U shaped gutter 10, shafts or pins 6 of clamp C each are moved upwardly in a slidable fashion in guide slit 4. Pins 6 thereby open the lower end of clamp C, because joint 5 is not constructed so as to exhibit expandability.

In the embodiment shown in FIG. 2, expandable joint 18 is kept half contracted by the previous operation to close chuck arms 16 of hydraulic chuck 3 and position shoes 17 of arms 16 below the distal ends 6' of pin 6, to thereby maintain each of the pins 6 in an upper portion of guide slit 4, resulting in the lower end of clamp C being kept open.

Thus, each of the embodiments shown in FIGS. 1 and 5 utilize the flexibility of joint 5 and pivotal movement of box 15 of hydraulic chuck 3 to operate clamp C as desired. Thus, non-slip sections 7 of the clamp C is abuttedly engaged with both outer sides of U-shaped gutter 10 (FIG. 1) or both surfaces of each of the side walls of U-shaped gutter 10 (FIG. 5). Thus, raising of arm 1 permits second bracket B1 and the members arranged above bracket B2 to be lifted. This lifting causes shafts or pins 6 of clamp C to slide downwardly in guide slits 4 and thus close clamp C, resulting in U-shaped gutter 10 being held by clamp C.

In the embodiment shown in FIG. 2, chuck arms 16 are actuated so as to be open, to thereby cause shoes 17 to be retreated. Then, when arm 1 is raised, the released pins 6 are slid downwardly in guide slits 4 to close clamp C to interposedly hold U-shaped gutter 10 between arm members 8 of clamp C.

When the arm 1 is raised further, the weight of U-shaped gutter 10 causes pins 6 to tend to be lowered further in guide slits 4, so that clamp C firmly holds U-shaped gutter 10. Then, arm 1 is operated to transfer U-shaped gutter 10 to a desired target place.

In each of the embodiments shown in FIGS. 1 and 5, when the U-shaped gutter 10 is placed on a desired target place, arm 1 is slightly lowered to slide pins 6 upwardly in guide slits 4. This results in the opening of clamp C[,] and gutter 10 being released from clamp C.

In the embodiment of FIG. 2, when the U-shaped gutter 10 is placed on a target place, arm 1 is slightly lowered to contract expandable joint 18 and concurrently close chuck arms 16 to position shoes 17 below the distal ends 6' of pins 6. Then, arm 1 is raised to move arms 16 upwardly and in turn shoes 17, so that the distal ends 6' of pins 6 may be forcibly slid upwards in guide slits 4. Thus, clamp C is rendered open to release the U-shaped gutter 10 therefrom. Then, the clamp is returned to the above-described state while being kept open by shoes 17.

In the embodiment shown in FIG. 6, arm members 8 of clamp C are substantially L-shaped and may be arranged symmetrically with respect to each other about pivot 9. Thus, when arm 1 is raised to slide pins 6 downwardly in guide slits 4, non-slip sections 7 are laterally open or separated from each other. This permits construction material 10 to be inserted into clamp C and then transferred.

In the embodiment shown in FIG. 7, arm members 8 of clamp C, as described above, are arranged so as to form an X-shape in cooperation with each other as in FIGS. 1, 2, and 5. However, guide slits 4 of bracket B2, as described above, are so arranged so that the upper ends thereof are kept away from each other and the lower ends thereof approach each other. Thus, raising of arm 1 permits clamp C to be expanded to abut each non-slip section 7 against the inner surface of construction material 10 as in the embodiment of FIG. 6. This results [in construction material 10 being transferred while being held by clamp C.

The clamp device of the present invention may be constructed by optionally combining or partially substituting at least one of the embodiments of FIGS. 6 and 7 with or for a least one of the embodiments of FIGS. 1, 2 and 5.

As can be seen from the foregoing, the clamp device of the present invention is so constructed that brackets B1 and B2 are connected to each other through a joint and bracket B2 is engaged with clamp C. Thus, the present invention may provide a clamp device with highly increased rigidity sufficient to permit it to exhibit durability for a long period of time irrespective of the manner of use in a construction site.

The clamp device of the present invention may readily be used because bracket B1 is suitably mounted on an arm of a civil engineering machine such as a hydraulic shovel.

Also, the clamp device includes a joint capable of exhibiting significantly increased rigidity as compared with the above-described wire in the prior art, to thereby substantially eliminate occurrence of the above-described accidents or troubles encountered with the prior art. Also, the joint exhibits flexibility and the hydraulic chuck exhibits pivotal movement, so that setting and releasing of the construction material with respect to the clamp are facilitated as desired.

In addition, in the clamp device of the present invention, bracket B2 is provided with guide slits, in which shafts or pins of clamp C are engagedly fitted. Thus, downward sliding of pins in guide slits permits clamp C to be automatically operated to safely and firmly hold the construction material. Thus, the construction material may be transferred with ease and high efficiency.

Moreover, in the present invention, the arm of the hydraulic shovel is lowered to abut the lower end of the clamp against the construction material to move it slightly downward. Alternatively, only operation of the chuck arms permits the pins to be slid upwardly in the guide slits to operate the clamp. Thus, the present invention ensures safe and positive transferring of the construction material while supporting it, as well as releasing of the material from the clamp.

Furthermore, the present invention permits an operator for the hydraulic shovel to accomplish the whole transferring operation without needing any manual operation of loading and unloading the construction material with respect to the clamp, to thereby attain significant labor saving.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A clamp device for transferring construction materials which is adapted to be mounted on an arm of a hydraulic shovel, comprising:

a first bracket mounted on said arm of said hydraulic shovel;

a second bracket formed with guide slits;

a joint for connecting said first and second brackets to each other, said joint for reducing the transient loads placed upon said construction material by said clamp device and thereby reducing the likelihood of accidental release of said construction material from said clamp device;

a scissors-like clamp including arm members each provided at an upper end thereof with a pin and at a lower end thereof with a non-slip means;

said arm members being pivotally connected to each other through a pivot not in direct communication with said joint;

said pins of said arm members being slidably fitted in said guide slits of said second bracket, to thereby connect said clamp to said second bracket.

2. A clamp device as defined in claim 1, wherein said second bracket comprises a box which is open at a bottom thereof.

3. A clamp device as defined in claim 2, wherein said slits of said second bracket are formed so as to vertically obliquely extend in a substantially symmetric manner.

4. A clamp device as defined in claim 1, wherein said joint is angularly variable.

5. A clamp device as defined in claim 4, wherein said joint is pivotally arranged so as to pivot about a line extending from said first bracket to said second bracket.

6. A clamp device as defined in claim 1, wherein said arm members are pivotally connected to a central portion thereof through said pivot.

7. A clamp device as defined in claim 6, wherein the connection between said arm members are carried out so as to form an X-like shape in cooperation with each other.

8. A clamp device as defined in claim 6, wherein said arm members are formed into a substantially L-shape and symmetrically arranged about said pivot.

* * * * *